US007066117B2

(12) United States Patent
Nishikawa et al.

(10) Patent No.: US 7,066,117 B2
(45) Date of Patent: Jun. 27, 2006

(54) COMBUSTION CHAMBER ARRANGEMENT IN COMBUSTION TYPE POWER TOOL

(75) Inventors: Tomomasa Nishikawa, Hitachinaka (JP); Hiroto Inagawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 44 days.

(21) Appl. No.: 10/997,944

(22) Filed: Nov. 29, 2004

(65) Prior Publication Data

US 2005/0116006 A1 Jun. 2, 2005

(30) Foreign Application Priority Data

Nov. 27, 2003 (JP) ..... P2003-397790

(51) Int. Cl.
*B25C 1/04* (2006.01)

(52) U.S. Cl. ..... 123/46 SC; 123/46 R; 227/8; 227/9; 227/10; 227/11

(58) Field of Classification Search ..... 227/8, 227/9, 10, 11; 123/46 R, 46 SC
See application file for complete search history.

(56) References Cited

U.S. PATENT DOCUMENTS 4,403,722 A 9/1983 Nikolich
4,483,280 A 11/1984 Nikolich
4,483,473 A 11/1984 Wagdy
4,483,474 A 11/1984 Nikolich
4,522,162 A 6/1985 Nikolich
RE32,452 E 7/1987 Nikolich
5,191,861 A * 3/1993 Kellerman et al. ..... 123/46 SC
5,197,646 A 3/1993 Nikolich
5,860,580 A * 1/1999 Velan et al. ..... 227/10
5,909,836 A * 6/1999 Shkolnikov et al. ..... 227/8
5,971,245 A * 10/1999 Robinson ..... 227/10
6,145,724 A * 11/2000 Shkolnikov et al. ..... 227/8
6,951,194 B1 * 10/2005 Nishikawa et al. ..... 123/46 R
6,983,871 B1 * 1/2006 Shima et al. ..... 227/8

FOREIGN PATENT DOCUMENTS

EP 0 560 049 A1 9/1993

* cited by examiner

*Primary Examiner*—John Sipos
*Assistant Examiner*—Nathaniel Chukwurah
(74) *Attorney, Agent, or Firm*—Antonelli, Terry, Stout and Kraus, LLP.

(57) ABSTRACT

A combustion type power tool capable of restraining reduction in output power due to lowering of combustion efficiency. A specific space within a combustion-chamber frame is enlarged. The specific space contains a specific region where high turbulence occurs in a combustion chamber at which a fuel is ignited. The enlargement is made by providing an enlarged distance between a rotation shaft of the fan and an inner wall of the combustion-chamber frame. When the turbulent combustion occurring at the specific region is expanded in the combustion chamber, flame propagation contour of the turbulent combustion reaches the wall of the combustion-chamber frame and ribs at a delayed timing. Therefore, after the turbulent combustion is sufficiently promoted, the flame reaches the combustion-chamber frame and the ribs. In other words, the flame does not reach the combustion-chamber frame and the ribs at the initial stage of turbulent combustion.

11 Claims, 8 Drawing Sheets

COMBUSTION CHAMBER ARRANGEMENT IN COMBUSTION TYPE POWER TOOL

BACKGROUND OF THE INVENTION

The present invention relates to a combustion-type power tool, and more particularly, to such power tool capable of providing sufficient combustion efficiency.

In a conventional combustion-type driving tool such as a nail gun, a gaseous fuel injected into a combustion chamber is ignited to cause gas expansion in the combustion chamber, which in turn causes a linear momentum of a piston. By the movement of the piston, a nail is driven into a workpiece. Such conventional combustion-type driving tool is disclosed in U.S. Pat. No. 4,483,280, Re 32,452 and U.S. Pat. No. 5,197,646.

In the above-described conventional combustion type power tool, heat generated upon combustion of a fuel in the combustion chamber is robbed or absorbed at the inner surface of the combustion chamber, so that the combustion is restrained prior to complete combustion of the fuel. Thus, driving output for striking the nail may be lowered because combustion efficiency is lowered.

SUMMARY OF THE INVENTION

It is therefore an object of the present invention to provide a combustion type power tool capable of restraining lowering of the output due to lowering of combustion efficiency To attain the above described object, the present invention provides a combustion chamber arrangement in a combustion-type power tool including a combustion-chamber frame, a fan disposed in the combustion chamber and rotatable about an axis in a rotational direction; and an ignition plug exposed to the combustion chamber. The combustion-chamber frame has a specific section and a remaining section other than the specific section, and a distance between the axis and the inner wall of the specific section in a plane perpendicular to the axis is greater than a distance between the axis and the inner wall of the remaining section in the plane. The specific section ranges from −30 to 150 degrees about the axis relative to a connection line connecting between the axis and the ignition plug in the rotational direction.

After the injected fuel is ignited by the ignition plug, the turbulent combustion having an accelerated combustion speed occurs by the rotation of the fan, and the flame is propagated in the rotational direction of the fan. Because sufficient distance between the starting point of the turbulent combustion and the inner surface of the combustion chamber is provided, cooling to the combustion gas during its thermal expansion can be retarded. Thus, lowering of the combustion efficiency due to cooling to the combustion gas can be restrained. In other words, the above-described structure can permit a flame propagation contour as a result of a turbulent combustion providing higher combustion speed to retardedly reach the inner surface of the combustion chamber at an early stage of combustion. Thus, lowering of output due to robbing of the combustion heat at the early stage of combustion can be restrained.

Further, the specific section can be in a range of from 30 to 70 degrees about the axis of the fan relative to the connection line in the rotational direction of the fan. With this arrangement, when the fuel is burned, reaching of a flame propagation contour generated at the most accelerated combustion position due to the turbulent combustion to the inner surface of the combustion chamber can be retarded at an early stage of the combustion. Thus, lowering of output due to robbing of the combustion heat at the early stage of combustion can be restrained.

In other words, after the injected fuel is ignited by the ignition plug, the turbulent combustion having an accelerated combustion speed occurs by the rotation of the fan, and the flame is propagated in the rotational direction of the fan. In this case, because sufficient distance between the starting point of the turbulent combustion and the inner surface of the combustion chamber is provided at a position where the start of the turbulent combustion is most likely to occur, cooling to the combustion gas during its thermal expansion can be retarded. Thus, lowering of the combustion efficiency due to cooling to the combustion gas can be restrained at least at a position where the start of the turbulent combustion is most likely to occur.

Preferably, a plurality of ribs can extend in the axial direction of the fan and protrude from the inner wall of the combustion-chamber frame toward the axis of the fan and spaced away from each other. The plurality of ribs is only located at an area ranging from 150 to 330 degrees about the axis of the fan relative to the connection line in the rotational direction. With this arrangement, when the fuel is burned, ribs serving as heat absorption members do not exist at a position in confrontation with a flow of a flame propagation contour generated at an early stage of the turbulent combustion. Thus, lowering of output due to robbing of the combustion heat at the early stage of combustion can be restrained.

More specifically, after the injected fuel is ignited by the ignition plug, the turbulent combustion having an accelerated combustion speed occurs by the rotation of the fan, and the flame is propagated in the rotational direction of the fan. In this case, because no ribs serving as heat absorbing elements are provided in the flame propagating direction at an early stage of combustion, heat of the combustion gas cannot be absorbed by the rib but is absorbed when the flame reaches the inner surface of the combustion chamber. Thus, cooling to the combustion gas during combustion can be retarded. Thus, lowering of the combustion efficiency due to arrival of the turbulent combustion to the ribs for cooling the combustion gas at the ribs can be restrained.

Alternatively, the plurality of ribs are only located at an area ranging from 0 to 30 degrees and from 70 to 360 degrees about the axis of the fan relative to the connection line in the rotational direction. With this arrangement, when the fuel is burned, ribs serving as heat absorption members do not exist at a position in confrontation with a flow of a flame propagation contour generated at a combustion promoting position at an early stage of the turbulent combustion. Thus, lowering of output due to robbing of the combustion heat at the early stage of combustion can be restrained.

More specifically, after the injected fuel is ignited by the ignition plug, the turbulent combustion having an accelerated combustion speed occurs by the rotation of the fan, and the flame is propagated in the rotational direction of the fan. In this case, because no ribs serving as heat absorbing elements are provided in the flame propagating direction at the position where the turbulent combustion is most likely to occur at an early stage of combustion, heat of the combustion gas cannot be absorbed by the rib, but can be absorbed when the flame reaches the inner surface of the combustion chamber. Thus, cooling to the combustion gas during combustion can be retarded. Thus, lowering of the combustion efficiency due to arrival of the turbulent combustion to the ribs for cooling the combustion gas at the ribs can be restrained at the position where the turbulent combustion is most likely to occur. Consequently, efficient combustion can result.

Further alternatively, are provided a first plurality of ribs and a second plurality of ribs each extending in an axial direction of the fan and protruding from the inner wall of the combustion-chamber frame toward the axis of the fan and spaced away from each other. A surface area of the rib per a unit angle about the axis of the fan in the first plurality of ribs is smaller than that in the second plurality of ribs. The first plurality of ribs ranges from −30 to 150 degrees about the axis of the fan relative to the connection line in the rotational direction. With this arrangement, when the fuel is burned, surface area of the ribs serving as heat absorption members is small at a position in confrontation with a flow of a flame propagation contour generated at an early stage of the turbulent combustion. Thus, robbed amount of combustion heat at an early stage of the combustion can be lowered to restrain lowering of output.

More specifically, after the injected fuel is ignited by the ignition plug, the turbulent combustion having an accelerated combustion speed occurs by the rotation of the fan, and the flame is propagated in the rotational direction of the fan. In this case, even though ribs are provided in the propagating direction of the flame at an early stage of combustion, heat absorption amount absorbed into the ribs can be reduced when the flame reaches the ribs because the surface area of the ribs is small. Therefore, excessive cooling to the combustion gas can be avoided. Accordingly, even if the turbulent combustion gas reaches the ribs, lowering of the combustion efficiency due to cooling to the combustion gas can be restrained. Here, in order to reduce the surface area of the ribs, a gap between the neighboring ribs can be increased, or extension length of the ribs can be shortened, or protruding length of the ribs can be shortened.

In this case, the first plurality of ribs can range from 30 to 70 degrees about the axis of the fan relative to the connection line in the rotational direction of the fan. With this arrangement, when the fuel is burned, surface area of the ribs serving as heat absorption members is small at a position in confrontation with a flow of a flame propagation contour generated at a combustion promoting position at an early stage of the turbulent combustion. Thus, robbed amount of combustion heat at an early stage of the combustion can be lowered to restrain lowering of output.

More specifically, after the injected fuel is ignited by the ignition plug, the turbulent combustion havinQg an accelerated combustion speed occurs by the rotation of the fan, and the flame is propagated in the rotational direction of the fan. In this case, ribs are provided in the propagating direction of the flame and at the position where the turbulent combustion is most likely to occur. However, because the surface area of the ribs is sufficiently small, heat absorption amount absorbed into the ribs can be reduced when the flame reaches the ribs. Therefore, excessive cooling to the combustion gas can be avoided. Accordingly, even if the turbulent combustion gas reaches the ribs at the position where the start of turbulent combustion is most likely to occur, the cooling to the combustion gas can be reduced to restrain lowering of the combustion efficiency.

In another aspect of the invention, there is provided a combustion chamber arrangement in a combustion-type power tool including the combustion-chamber frame, the fan, the ignition plug, and a plurality of ribs extending in an axial direction of the fan and protruding from the inner wall toward the axis of the fan and spaced away from each other. The plurality of ribs are only located at an area ranging from 0 to 30 degrees and from 70 to 360 degrees about the axis relative to a connection line connecting between the axis and the ignition plug in the rotational direction.

After the injected fuel is ignited by the ignition plug, the turbulent combustion having an accelerated combustion speed occurs by the rotation of the fan, and the flame is propagated. in the rotational direction of the fan. In this case, because no ribs are provided. at the position where the turbulent combustion is most likely to occur, combustion heat is not absorbed into the ribs but is absorbed at the inner surface of the combustion chamber even in the case of the combustion type power tool in which a volume of the combustion chamber cannot be increased in view of structural requirement. Therefore, cooling to the combustion gas can be retarded. Accordingly, it is possible to restrain lowering of the combustion efficiency due to cooling to the combustion gas as a result of arrival of the turbulent combustion at the ribs at the position where the start of turbulent combustion is most likely to occur.

Here, the plurality of ribs can only be located at an area ranging from 150 to 330 degrees about the axis of the fan relative to the connection line in the rotational direction. After the injected fuel is ignited by the ignition plug, the turbulent combustion having an accelerated combustion speed occurs by the rotation of the fan, and the flame is propagated in the rotational direction of the fan. In this case, because no ribs are provided in the flame propagating direction, heat of the combustion gas cannot be absorbed by the rib but is absorbed when the flame reaches the inner surface of the combustion chamber even in the case of the combustion type power tool in which a volume of the combustion chamber cannot be increased in view of structural requirement. Thus, cooling to the combustion gas during combustion can be retarded. Thus, lowering of the combustion efficiency due to arrival of the turbulent combustion to the ribs for cooling the combustion gas at the ribs can be restrained.

In still another aspect of the invention, there is provided a combustion chamber arrangement in a combustion-type power tool including the combustion-chamber frame, the fan, the ignition plug, and, a first plurality of ribs and a second plurality of ribs each extending in an axial direction of the fan and protruding from the inner wall toward the axis and spaced away from each other. A surface area of the rib per a unit angle about the axis in the first plurality of ribs is smaller than that in the second plurality of ribs. The first plurality of ribs ranges from −30 to 150 degrees about the axis relative to the connection line in the rotational direction.

After the injected fuel is ignited by the ignition plug, the turbulent combustion having an accelerated combustion speed occurs by the rotation of the fan, and the flame is propagated in the rotational direction of the fan. In this case, even though ribs are provided in the propagating direction of the flame, heat absorption amount absorbed into the ribs can be reduced when the flame reaches the ribs because the surface area of the ribs is small even in the case of the combustion type power tool in which a volume of the combustion chamber cannot be increased in view of structural requirement and ribs cannot be dispensed with within the combustion chamber. Therefore, excessive cooling to the combustion gas can be avoided when the flame reaches the ribs to thus provide a smooth combustion and, as a result, efficient combustion can result.

Here, the first plurality of ribs can be in a range of from 30 to 70 degrees about the axis of the fan relative to the connection line in the rotational direction. After the injected fuel is ignited by the ignition plug, the turbulent combustion having an accelerated combustion speed occurs by the rotation of the fan, and the flame is propagated in the rotational direction of the fan. In this case, ribs are provided in the propagating direction of the flame and at the position where the turbulent combustion is most likely to occur. However, because the surface area of the ribs is sufficiently small, heat absorption amount absorbed into the ribs can be reduced when the flame reaches the ribs even in the case of the combustion type power tool in which a volume of the combustion chamber cannot be increased in view of structural requirement and ribs cannot be dispensed with within the combustion chamber. Therefore, excessive cooling to the combustion gas can be avoided. Accordingly, even if the turbulent combustion gas reaches the ribs, the cooling to the combustion gas can be reduced to thus provide a smooth combustion and, as a result, efficient combustion can result.

In order to realize this arrangement, each of the first plurality of ribs can have an extension length smaller than that of the second plurality of ribs. Alternatively, each of the first plurality of ribs can have a protruding length protruding from the inner wall toward the axis smaller than that of the second plurality of ribs. Further alternatively, the number of the first plurality of ribs can be smaller than that of the second plurality of ribs.

In still another aspect of the invention, there is provided a combustion-type power tool including a housing, a head section, a push lever, a cylinder, a piston, a combustion-chamber frame, a motor, a fan, and an ignition plug. The head section closes the one end of the housing and is formed with a combustible gas passage. The push lever is provided to the lower side of the housing and is movable upon pushing onto a workpiece. The cylinder is secured to an inside of the housing. The piston is slidably disposed in the cylinder and is reciprocally movable in an axial direction of the cylinder. The piston divides the cylinder into an upper cylinder space above the piston and a lower cylinder space below the piston. The combustion-chamber frame is provided in the housing and is guidedly movable along the cylinder. The combustion-chamber frame has one end abuttable on and separable from the head section in interlocking relation to the movement of the push lever. A combination of the combustion-chamber frame, the head section and the cylinder space above the piston defines a combustion chamber. The motor is disposed at the head section. The fan is rotatably positioned in the combustion chamber and driven by the motor. The ignition plug is provided at the head section and is exposed to the combustion chamber. The combustion-chamber frame has a specific section and a remaining section other than the specific section. A distance between an axis of the fan and an inner wall of the specific section in a plane perpendicular to the axis is greater than a distance between the axis of the fan and an inner wall of the remaining section in the plane. The specific section is in a range of from −30 to 150 degrees about the axis of the fan relative to a connection line connecting between the axis of the fan and the ignition plug in a rotational direction of the fan.

In still another aspect of the invention, there is provided a combustion-type power tool including the housing, the head section, the push lever, the cylinder, the piston, a combustion-chamber frame, the motor, the fan, the ignition plug, and a plurality of ribs extending in an axial direction of the fan and protruding from an inner wall of the combustion-chamber frame toward an axis of the fan and spaced away from each other. The plurality of ribs are only located at an area ranging from 0 to 30 degrees and from 70 to 360 degrees about the axis of the fan relative to a connection line connecting the axis of the fan to the ignition plug in the rotational direction of the fan.

In still another aspect of the invention, there is provided a combustion-type power tool including the housing, the head section, the push lever, the cylinder, the piston, a combustion-chamber frame, the motor, the fan, the ignition plug, and a first plurality of ribs and a second plurality of ribs each extending in an axial direction of the fan and protruding from the inner wall of the combustion-chamber frame toward the axis of the fan and spaced away from each other. A surface area of the rib per a unit angle about the axis of the fan in the first plurality of ribs is smaller than that in the second plurality of ribs. The first plurality of ribs is in a range of from −30 to 150 degrees about the axis of the fan relative to a connection line connecting between the axis of the fan and the ignition plug in the rotational direction of the fan.

DETAILED DESCRIPTION OF THE PREFERRED EMBODIMENTS

Figure 1:
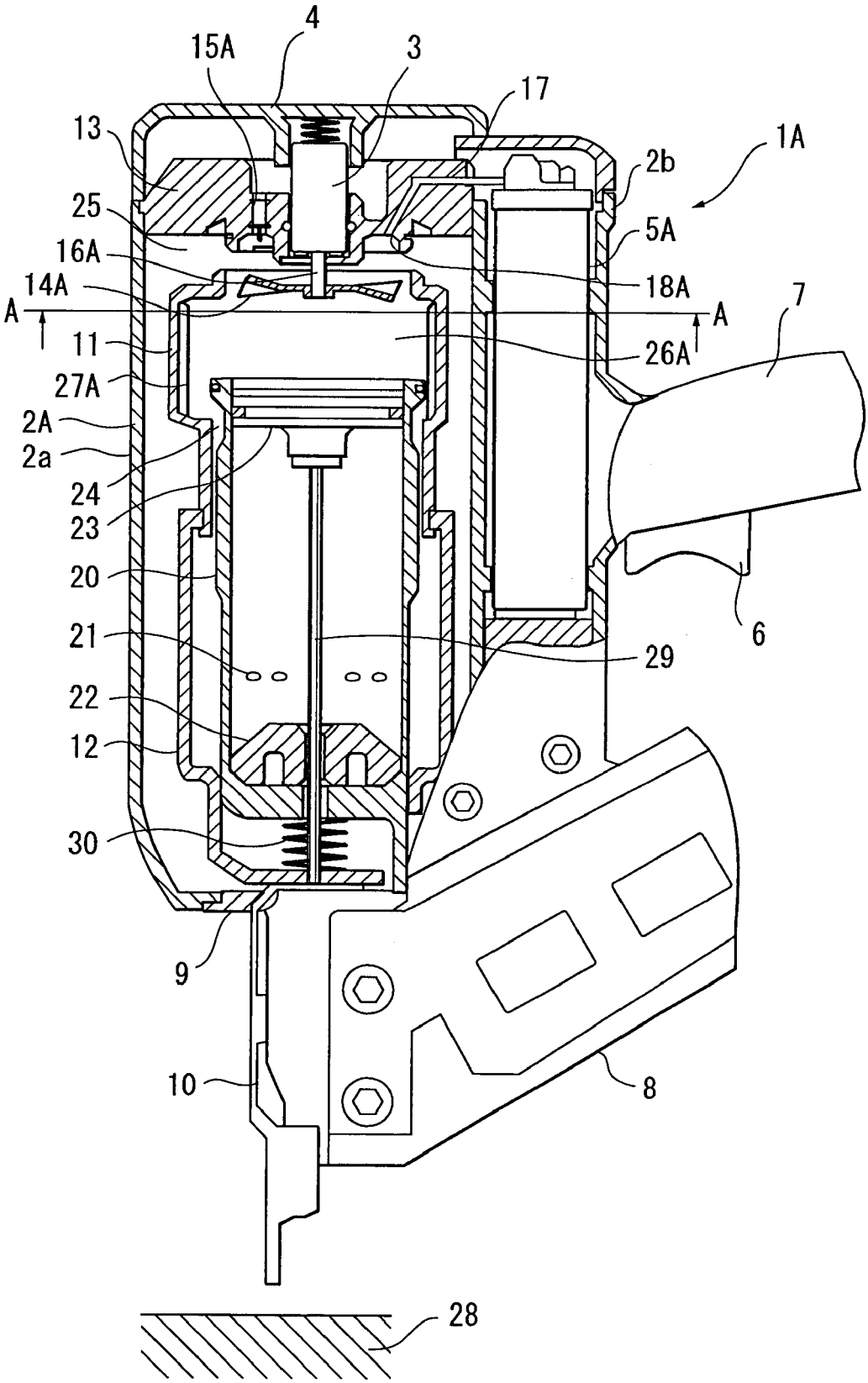
FIG. 1 is a vertical cross-sectional view showing a combustion type nail driving tool according to a first embodiment of a combustion type power tool of the present invention.

A combustion-type power tool according to a first embodiment of the present invention will be described with reference to FIGS. 1 through 3. The embodiment pertains to a combustion type nail driver. The combustion type nail driver 1 has a housing 2A constituting an outer frame and including a main housing 2*a* and a canister housing 2*b* juxtaposed to the main housing 2*a*.

A head cover 4 formed with an intake port is mounted on the top of the main housing 2*a*, and a gas canister 5A containing therein a combustible gas is detachably disposed in the canister housing 2*b*. A handle 7 extends from the canister housing 2*b*. The handle 7 has a trigger switch 6 and accommodates therein a battery (not shown). A magazine 8 and a tail cover 9 are provided on the bottoms of the main housing 2*a* and canister housing 2*b*. The magazine 8 contains nails (not shown), and the tail cover 9 is adapted to guidingly feed each nail in the magazine 8 and set the nail to a predetermined position.

A push lever 10 is movably provided at the lower end of the main housing 2*a* and is positioned in conformance with a nail setting position defined by the tail cover 9. The push lever 10 is coupled to a coupling member 12 that is secured to a combustion-chamber frame 11A which will be described later. When the entire housing 2 is pressed toward a workpiece 28 while the push lever 10 is in abutment with the workpiece against a biasing force of a compression coil spring 30 (described later), an upper portion of the push lever 10 is retractable into the main housing 2*a*.

A head cap 13 is secured to the top of the main housing 2*a* and closes the open top end of the main housing 2*a*. The head cap 13 supports a motor 3 having a motor shaft 16A, and a fan 14A is coaxially fixed to the motor shaft 16A. The head cap 13 also supports an ignition plug 15A ignitable upon manipulation to the trigger switch 6. A head switch (not shown) is provided in the main housing 2*a* for detecting an uppermost stroke end position of the combustion-chamber frame 11A when the power tool is pressed against the workpiece 28. Thus, the head switch can be turned ON when the push lever 10 is elevated to a predetermined position for starting rotation of the motor 3, thereby starting rotation of the fan 14A.

The head cap 13 has a canister housing 2*b* side in which is formed a fuel ejection passage 17 which allows a combustible gas to pass therethrough. One end of the ejection passage 17 serves as an ejection port 18A that opens at the lower surface of the head cap 13. Another end of the ejection passage 17 serves as a gas canister connecting portion in communication with a gas canister 5A.

The combustion-chamber frame 11A is provided in the main housing 2*a* and is movable in the lengthwise direction of the main housing 2*a*. The uppermost end of the combustion-chamber frame 11A is abuttable on the lower peripheral side of the head cap 13. The coupling member 12 described above is secured to the lower end of the combustion-chamber frame 11A and is connected to the push lever 10. Therefore, the combustion-chamber frame 11A is movable in interlocking relation to the push lever 10. A cylinder 20 is fixed to the main housing 2*a*. The inner circumference of the combustion-chamber frame 11A is in sliding contact with an outer peripheral surface of the cylinder 11 for guiding the movement of the combustion-chamber frame 11A. The cylinder 20 has an axially intermediate portion formed with an exhaust hole 21. The compression coil spring 30 is interposed between the coupling member 12 and the bottom of the cylinder 20 for biasing the push lever 10 in a direction away from the bottom of the cylinder 20. An exhaust-gas check valve (not shown) is provided to selectively close the exhaust hole 21. Further, a bumper 22 is provided on the bottom of the cylinder 20.

A piston 23 is slidably and reciprocally provided in the cylinder 20. The piston 23 divides an inner space of the cylinder 20 into an upper space above the piston 23 and a lower space below the piston 23. When the upper end of the combustion-chamber frame 11A abuts on the head cap 13, the head cap 13, the combustion-chamber frame 11A, the upper cylinder space above the piston 23 define in combustion a combustion chamber 26A. When the combustion-chamber frame 11A is separated from the head cap 13, a first flow passage 24 in communication with the atmosphere is provided between the head cap 13 and the upper end of the combustion-chamber frame 11A, and a second flow passage 25 in communication with the first flow passage 24 is provided between the lower end portion of the combustion-chamber frame 11A and the upper end portion of the cylinder 20. The second flow passage 25 allows a combustion gas and a fresh air to pass along the outer peripheral surface of the cylinder 20 for discharging these gas through an exhaust port (not shown) of the main housing 2*a*. Further, the above-described intake port is formed for supplying a fresh air into the combustion chamber 26A, and the exhaust hole 21 is adapted for discharging combustion gas generated in the combustion chamber 26A.

Figure 2:
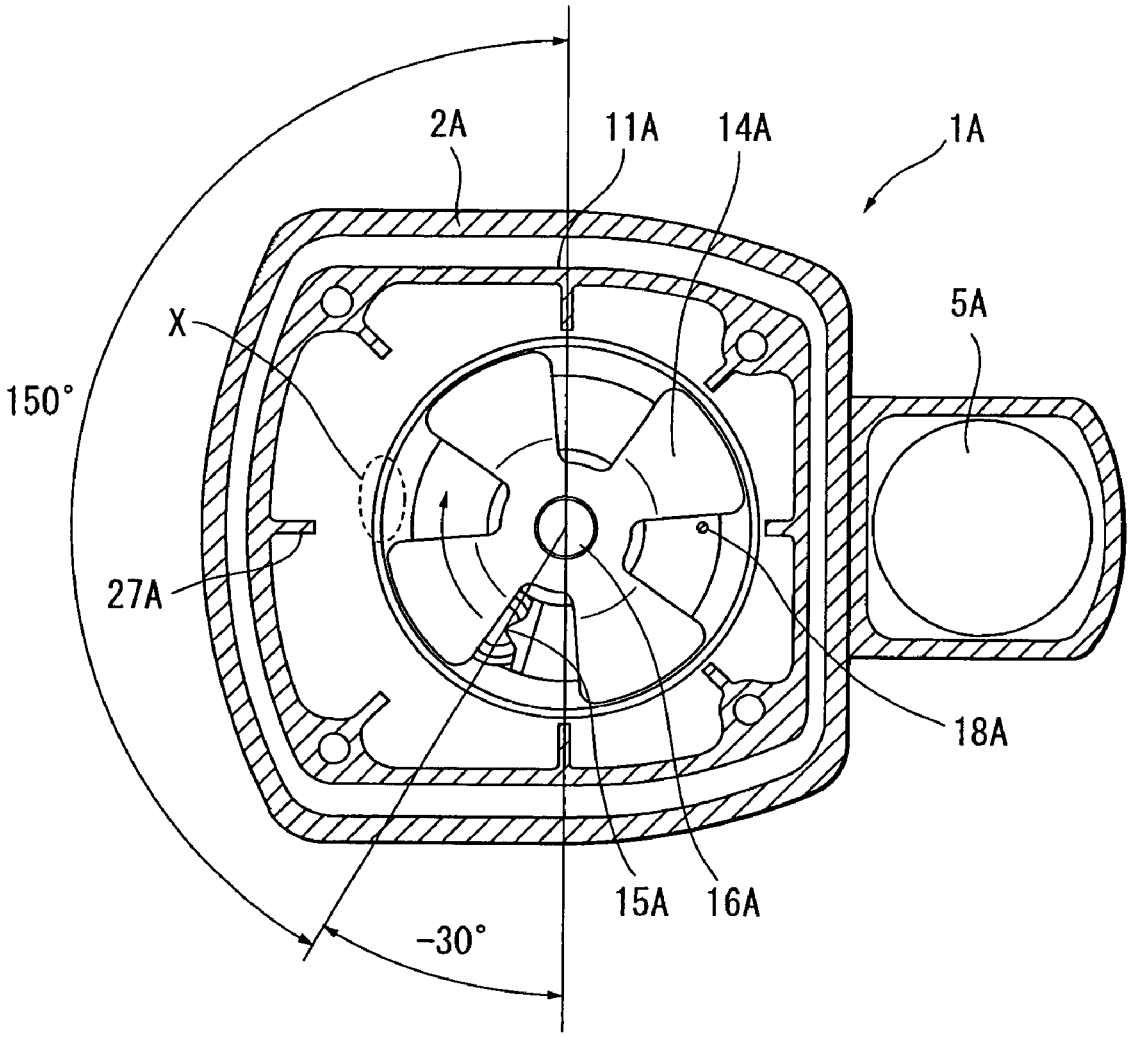
FIG. 2 is a cross-sectional view taken along the line A—A of FIG. 1.
Figure 3:
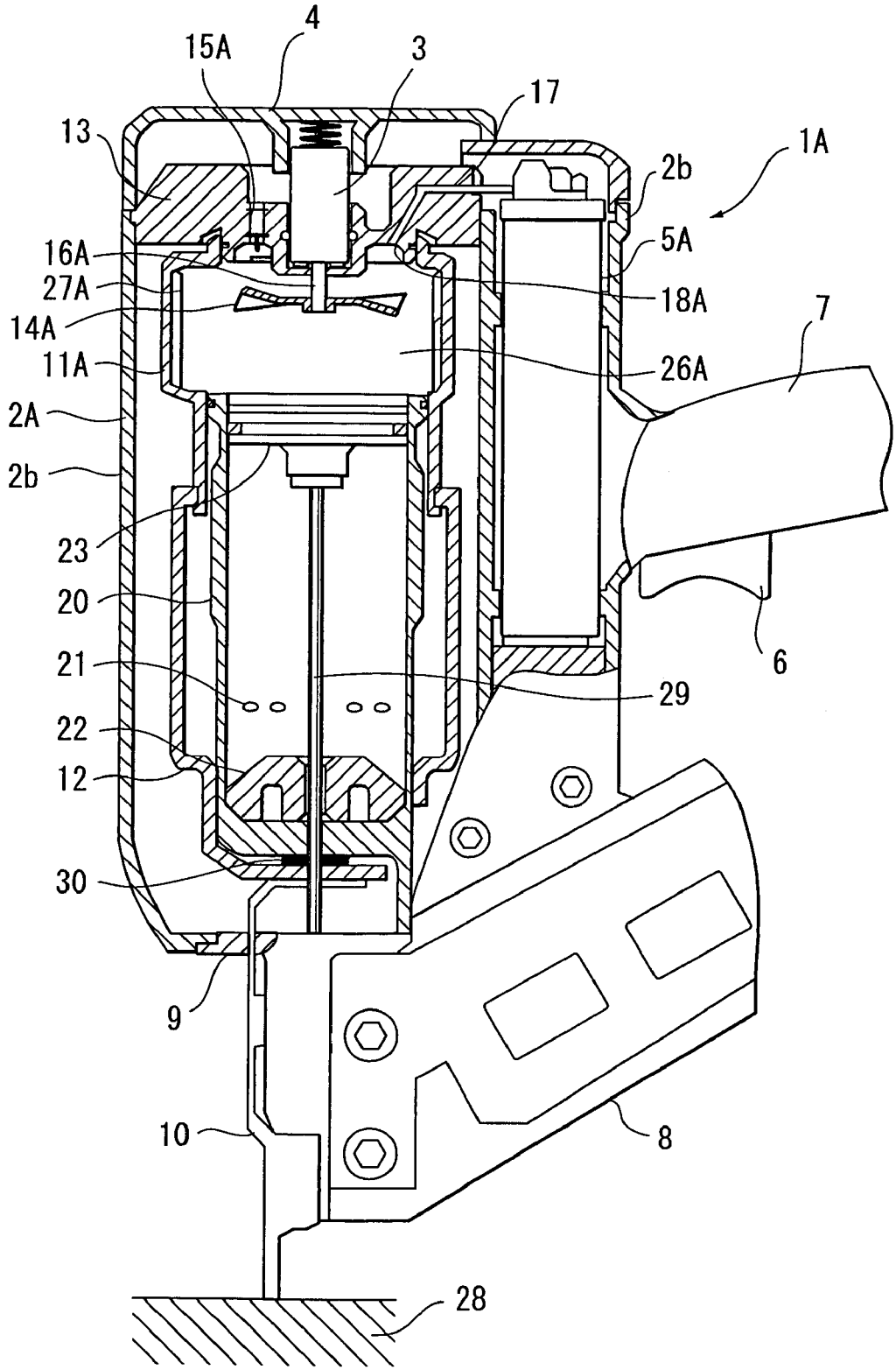
FIG. 3 is a vertical cross-sectional view showing the combustion type nail driving tool according to the first embodiment and showing the nail driving state.

As shown in FIG. 2, a plurality of ribs 27A are provided on the inner peripheral portion of the combustion-chamber frame 11A which portion defines the combustion chamber 26A. The ribs 27A extend in the lengthwise direction of the combustion-chamber frame 11A and project radially inwardly toward the axis of the main housing 2*a*. The portion of the combustion-chamber frame 11A defining the combustion chamber 26A has a specific section and a remaining section other than the specific section. The specific section is in a range from −30 to 150 degrees about the rotation axis of the fan 14A relative to a line connecting the axis of the fan and the ignition plug 15A in a rotational direction of the fan 14. In other words, the specific section is in a range of from −30 to 150 degrees from the position of the ignition plug 15A in the rotational direction of the fan 14A. A distance between the rotation axis of the fan 14A and an inner wall of the specific section in a plane perpendicular to the axis is greater than the distance between the rotation axis of the fan and an inner wall of the remaining section in the plane. The ribs 27A cooperate with the rotating fan 14A to promote stirring and mixing of air with the combustible gas in the combustion chamber 26A.

The fan 14A, the ignition plug 15A, and the fuel ejection port 18A are all disposed in or open to the combustion chamber 26A. Rotation of the fan 14A performs the following three functions. First, the fan 14A stirs and mixes the air with the combustible gas as long as the combustion-chamber frame 11A remains in abutment with the head cap 13. Second, after the mixed gas has been ignited, the fan 14A causes turbulence of the air-fuel mixture, thus promoting the combustion of the air-fuel mixture in the combustion chamber 26A. Third, the fan 14A performs scavenging such that the exhaust gas in the combustion chamber 26A can be scavenged therefrom and also performs cooling to the combustion-chamber frame 11A and the cylinder 20 when the combustion-chamber frame 11A moves away from the head cap 13 and when the first and second flow passages 24, 25 are provided.

A driver blade 29 extends downwards from a side of the piston 23, the side being at the cylinder space below the piston 23, to the lower end of the main housing 2*a*. The driver blade 29 is positioned coaxially with the nail setting position in the tail cover 9, so that the driver blade 29 can strike against the nail during downward movement of the piston 23. When the piston 23 moves downward, the piston 23 abuts on the bumper 22 and stops. In this case, the bumper 22 absorbs a surplus energy of the piston 23.

Operation of the combustion type nail driver 1A according to the first embodiment will next be described. In the non-operational state of the combustion type nail driver 1A, the push lever 10 is biased downward by the biasing force of the compression coil spring 30, so that the push lever 10 protrudes from the lower end of the tail cover 9. Thus, the uppermost end of the combustion-chamber frame 11A is spaced away from the head cap 13 because the coupling member 12 couples the combustion-chamber frame 11A to the push lever 10. Further, a part of the combustion-chamber frame 11A which part defines the combustion chamber 26A is also spaced from the top portion of the cylinder 20. Hence, the first and second flow passages 24 and 25 are provided. In this condition, the piston 23 stays at the top dead center in the cylinder 20.

With this state, if the push lever 10 is pushed onto the workpiece 28 while holding the handle 7 by a user, the push lever 10 is moved upward against the biasing force of the compression coil spring 30. At the same time, the combustion-chamber frame 11A which is coupled to the push lever 10, is also moved upward, closing the above-described flow passages 24 and 25. Thus, the sealed combustion chamber 26A is provided.

In accordance with the movement of the push lever 10, the gas canister 5A is tilted toward the head cap 13 by an action of a cam (not shown). Thus, the injection rod (not shown) of the gas canister 5A is pressed against the connecting portion of the head cap 13. Therefore, the liquidized gas in the gas canister 5A is ejected once into the combustion chamber 26A through the ejection port 18A.

Further, in accordance with the movement of the push lever 10, the combustion-chamber frame 11A reaches the uppermost stroke end whereupon the head switch is turned ON to start rotation of the fan 14A. Rotation of the fan 14A and the ribs 27A protruding into the combustion chamber 26A cooperate, stirring and mixing the combustible gas with air in the combustion chamber 26A. In this state, when the trigger switch 6 provided at the handle 7 is turned ON, spark is generated at the ignition plug 15A to ignite the combustible gas.

At this time, the fan 14A keeps rotating in the combustion chamber 26A, so that the air-fuel mixture flowing near the outer peripheral edge of the fan 14A provides the most highest turbulent flow. Moreover, the gas combustion at the high turbulence area provides higher combustion speed. In the combustion, a laminar state combustion flash point with lesser heat and lesser expansion and generated at the ignition plug 15A is moved in the rotating direction of the fan 14A. After the flash point reaches an area X in FIG. 2 where high turbulence is occurring, an explosive turbulent combustion accompanying heat generation and expansion will be started from the area X. Even through the area X at which the turbulent combustion is started may vary depending upon the degree of combustion, the area X is generally located at 50 degrees about the rotation axis of the fan 16A and with respect to a line connecting the rotation axis and the ignition plug 15A in a rotational direction of the fan 14A. Because the fan 14A is positioned at approximately center of the combustion chamber 26A, the turbulent combustion starting area X is within the combustion-chamber frame 11A and nearby the ribs 27A. If the flame propagation contour at the front end of the combustion portion reaches the inner surface of the combustion chamber flame 11A and the ribs 27A, heat generated by the combustion may be absorbed at the surfaces of the inner surface and the ribs 27A. Therefore, cooling and contraction may occur in the thermally expanded gas.

Therefore, the turbulent combustion generated at the area X must be protected. To this effect, as shown in FIG. 2, the portion of the combustion-chamber frame 11A defining the combustion chamber has the specific section and the remaining section other than the specific section. The specific section is in a range from about −30 to 150 degrees about the rotation axis of the fan 14A relative to a line connecting the axis of the fan and the ignition plug 15A in the rotational direction of the fan 14A, and the distance between the rotation axis of the fan 14A and an inner wall of the specific section in a plane perpendicular to the axis is greater than the distance between the rotation axis of the fan and an inner wall of the remaining section in the plane. With this arrangement, immediately after the turbulent combustion is generated at the area X, the flame propagation contour of the turbulent combustion does not contact the inner surface of the combustion-chamber frame 11A. Therefore, at an initial stage of the turbulent combustion, no heat transmission occurs from the combustion gas forming the turbulent combustion to the combustion-chamber frame 11A. Consequently, promotion of the turbulent combustion will not be inhibited.

The combusted and expanded gas pushes the piston 23 downward. Therefore, a nail in the tail cover 9 is driven into the workpiece through the driver blade 29 until the piston 23 abuts on the bumper 22.

After the nail driving, the piston 23 strikes against the bumper 22, and the combustion gas is discharged out of the cylinder 20 through the exhaust hole 21 of the cylinder 20 and through the check valve (not shown) provided at the exhaust hole 21. When the inner space of the cylinder 20 and the combustion chamber 26A becomes the atmospheric pressure, the check valve is closed. Combustion gas still remaining in the cylinder 20 and the combustion chamber 26A has a high temperature at a phase immediately after the combustion. However, the high temperature can be absorbed into the walls of the cylinder 20 and the combustion-chamber frame 11A to rapidly cool the combustion gas. Thus, the pressure in the sealed space in the cylinder 20 above the piston 23 further drops to less than the atmospheric pressure (creating a so-called "thermal vacuum"). Accordingly, the piston 23 is moved back to the initial top dead center position.

Then, the trigger switch 6 is turned OFF, and the user lifts the combustion type nail driver 1A from the workpiece for separating the push lever 10 from the workpiece 28. As a result, the push lever 10 and the combustion-chamber frame 11A move downward due to the biasing force of the compression coil spring 30 to restore a state shown in FIG. 1. In this case, the fan 14A keeps rotating for a predetermined period of time in spite of OFF state of the trigger switch 6 because of an operation of a control portion (not shown). In the state shown in FIG. 1, the flow passages 24 and 25 are provided again at the upper and lower sides of the combustion chamber, so that fresh air flows into the combustion chamber 26A through the intake port and through the flow passages 24, 25, expelling the residual combustion gas through the exhaust port (not shown). Thus, the combustion chamber 26A is scavenged. Then, the rotation of the fan 14A is stopped to restore an initial stationary state. Thereafter, subsequent nail driving operation can be performed by repeating the above described operation process.

As described above, in the combustion type nail driver 1A, expansion of the gas in the combustion chamber 26A is used as a power source for driving a nail. Thus, according to the first embodiment, the gas can be efficiently heated and expanded, to enhance driving performance and operability because of the geometrical relationship between the rotational center of the fan 14A and the inner wall of the combustion-chamber frame 11A.

A combustion type nail driving tool 1B which embodies a combustion type power tool and in accordance with a second embodiment will be described with reference to FIG. 4. The second embodiment is approximately the same as the first embodiment, and therefore, duplicating description will be omitted.

In the combustion type nail driving tool 1A according to the first embodiment, the distance between the rotation axis of the fan 14A and the inner surface of the specific section of the combustion-chamber frame 11A is greater than the distance between the rotation axis and the inner surface of the remaining section of the combustion-chamber frame 11A, the specific section being in a range from about −30 to 150 degrees about the rotation axis and relative to the position of the ignition plug 15A in the rotational direction of the fan.

Figure 4:
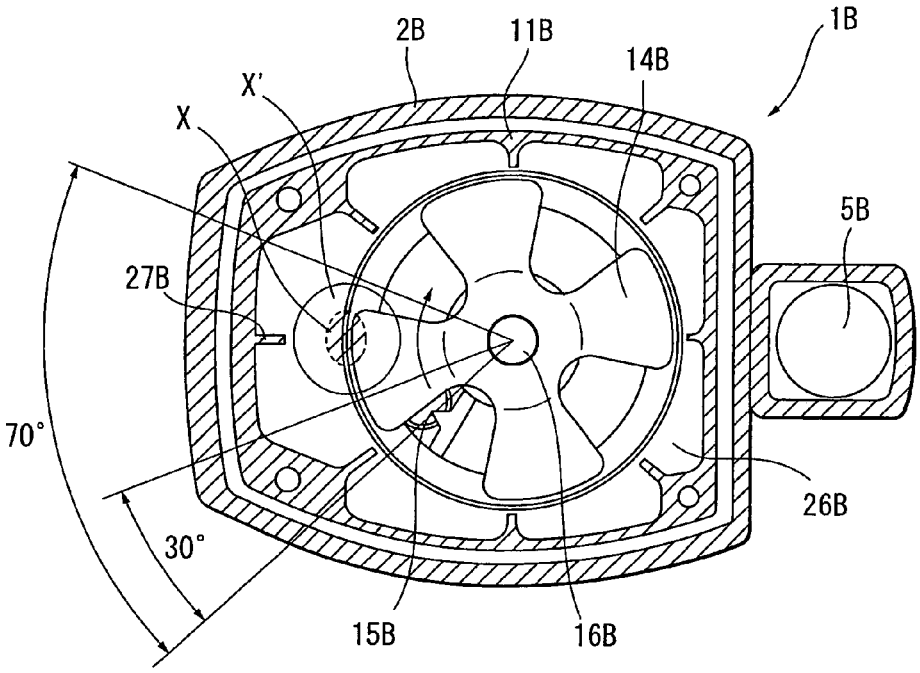
FIG. 4 is a cross-sectional view showing a combustion type nail driving tool according to a second embodiment and taken along a line corresponding to the line A—A of FIG. 1.

As shown in FIG. 4, because the starting area X at which the turbulent combustion is started is at about 50 degrees from the ignition plug 15B in the rotational direction of the fan 14B, a position where the combustion is most developed as a result of generation of the turbulent combustion is designated by X' in FIG. 4. An angular range containing the area X' is represented as 30 to 70 degrees from the position of the ignition plug 15B in the rotational direction of the fan and about a rotational axis of the fan 14B.

Therefore, according to the second embodiment, at least the area ranging from about 30 to 70 degrees about the rotation axis 16B and from the position of the ignition plug 15B in the rotational direction of the fan 14B has the increased distance between the inner surface of the combustion-chamber frame 11B and the rotation axis 16B as shown in FIG. 4, This structure is particularly effective even in a case where, due to the structural reason or the like, increased distance between the inner surface of the combustion-chamber frame 11B and the rotation axis of the fan 14B cannot be provided at an area ranging from about −30 to 150 degrees about the rotation axis 16B and from the position of the ignition plug 15B in the rotational direction of the fan.

With the structure in the second embodiment, immediately after the turbulent combustion is generated at the area X, flame propagation contour of the turbulent combustion does not reach the inner surface of the combustion-chamber frame 11B. Therefore, at the initial stage of the turbulent combustion, heat transmission from the combustion gas forming the turbulent combustion to the combustion-chamber frame 11B does not occur. As a result, the development of the turbulent combustion is not disturbed. Consequently, combustion of the combustible gas in the combustion chamber 26B is not excessively restrained, but the combustible gas in the combustion chamber 26B is efficiently heated and expanded, thereby improving driving performance of the combustion type nail driving tool 1B and enhancing operability.

Figure 5:
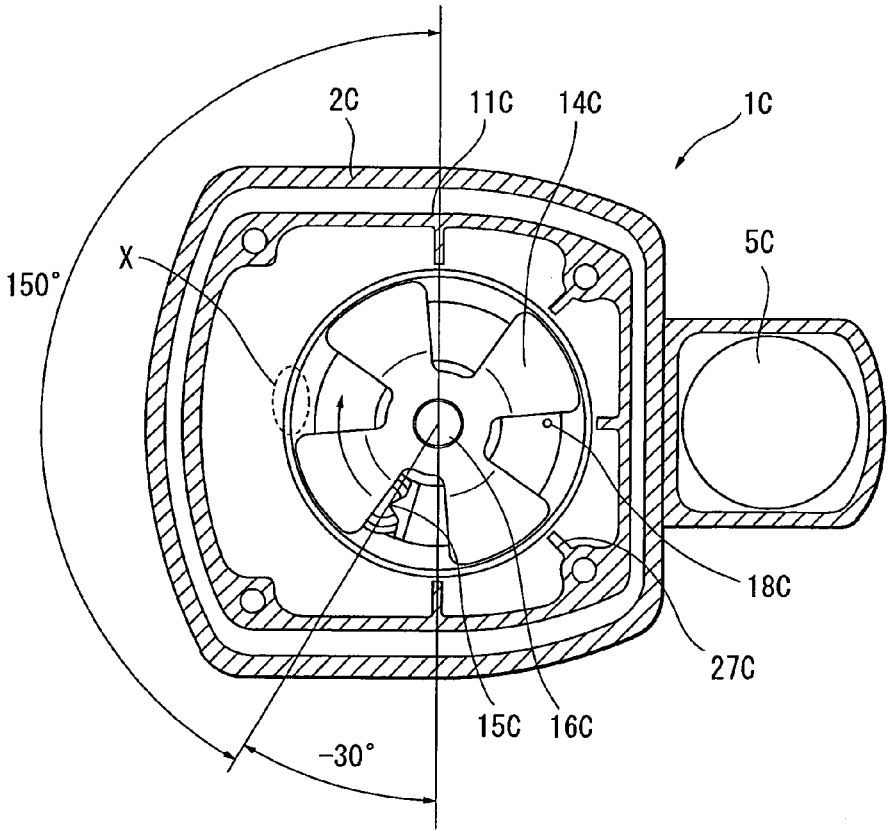
FIG. 5 is a cross-sectional view showing a combustion type nail driving tool according to a third embodiment and taken along a line corresponding to the line A—A of FIG. 1.

A combustion type nail driving tool 1C according to a third embodiment will next be described with reference to FIG. 5. The third embodiment is approximately the same as the first embodiment, and therefore, duplicating description will be omitted.

In the combustion type nail driving tool 1A according to the first embodiment, ribs are provided not locally but equidistantly over an entire inner peripheral surface of the combustion-chamber frame 11A at a portion forming the combustion chamber 26A. In the third embodiment, as shown in FIG. 5, ribs 27C are locally provided about the rotation axis (i.e., the motor shaft 16C) and from 150 to 330 degrees from the position of the ignition plug 15C in the rotational direction of the fan 14C.

With this structure, after the turbulent combustion occurs, no component is provided which robs the heat of the combustion gas until the flame propagation contour reaches the combustion-chamber frame 11C. Therefore, development of the turbulent combustion is not disturbed. Accordingly, at the initial stage of the turbulent combustion, heat transmission from the combustion gas forming the turbulent combustion to the combustion-chamber frame 11C does not occur. As a result, the development of the turbulent combustion is not disturbed.

Figure 6:
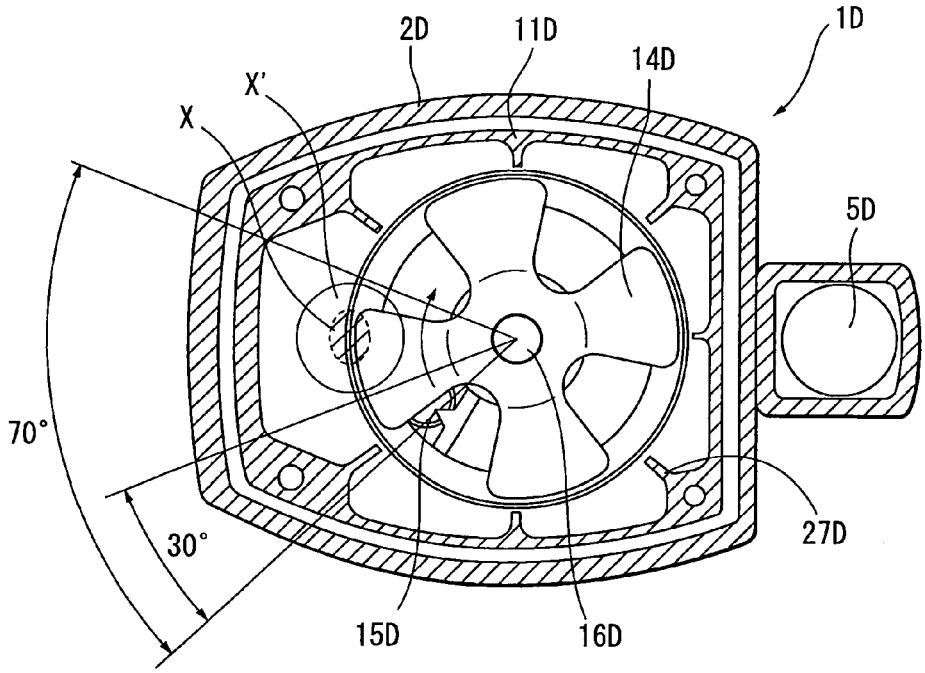
FIG. 6 is a cross-sectional view showing a combustion type nail driving tool according to a fourth embodiment and taken along a line corresponding to the line A—A of FIG. 1.

FIG. 6 shows a combustion type nail driving tool 1D according to a fourth embodiment. The fourth embodiment is approximately the same as the first embodiment, and therefore, duplicating description will be omitted.

As described in connection with the second embodiment, the position where the combustion is most promoted is ranging from 30 to 70 degrees about the rotation axis from the position of the ignition plug in the rotational direction of the fan. Therefore, as shown in FIG. 6, ribs 27D are disposed at least at the area ranging from about 0 to 30 degrees and from 70 to 360 degrees about the rotation axis i.e., the motor shaft 16D from the position of the ignition plug 15D in the rotational direction of the fan 14D. In other words, ribs 27D are not provided at an area ranging from 30 to 70 degrees.

With this arrangement, after the turbulent combustion occurs and until the flame propagation contour reaches from the position where the turbulent combustion is most promoted to the combustion-chamber frame 11D, no component exists which robs the heat of the combustion gas. Thus, promotion of the turbulent combustion is not disturbed. Accordingly, at an initial stage of turbulent combustion, heat transmission does not occur from the combustion gas to the combustion-chamber frame 11D at the position where the turbulent combustion is the most promoted. Thus, promotion of the turbulent combustion is not disturbed.

Figure 7:
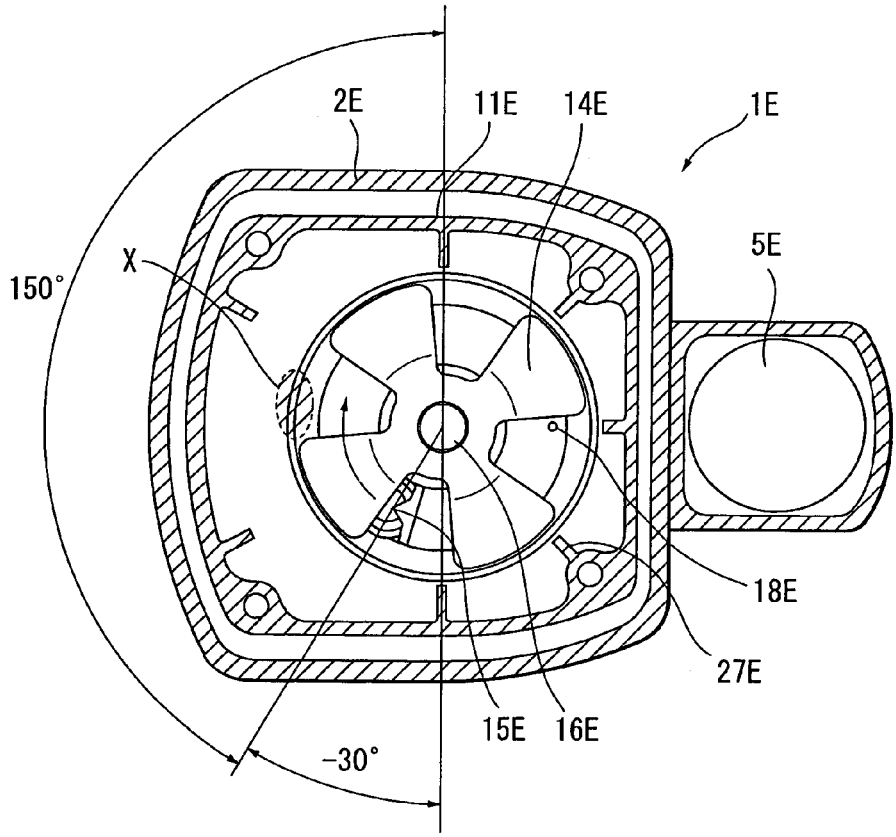
FIG. 7 is a cross-sectional view showing a combustion type nail driving tool according to a fifth embodiment and taken along a line corresponding to the line A—A of FIG. 1.

FIG. 7 shows a combustion type nail driving tool 1E according to a fifth embodiment of the present invention. The fifth embodiment is approximately the same as the first embodiment, and therefore, duplicating description will be omitted.

In the first embodiment, the ribs are provided at the inner surface of the combustion chamber space with a constant interval. In case where the ribs cannot be dispensed with because of the necessity of strength of the combustion-chamber frame, intervals between the neighboring ribs 27E is set greater in an area ranging from −30 to 150 degrees about the rotation axis i.e., motor shaft 16E and from the position of the ignition plug 15E in the rotational direction of the fan 14E than that of the remaining ribs in an area ranging from 150 to 330 degrees. Further, surface area of the ribs provided within this range from −30 to 150 degrees is smaller than that of the remaining ribs.

With this arrangement, when the flame propagation contour reaches the inner surface of the combustion-chamber frame 11E, heat transmission amount from the combustion gas to the ribs 27E can be reduced because the surface area of the ribs at that area is small. Accordingly, after the turbulent combustion occurs and the flame propagation contour reaches the inner surface of the combustion-chamber frame 11E, promotion of the turbulent combustion is not so much disturbed because heat transmission amount to the ribs 27E at that area is small. Consequently, at an initial stage of turbulent combustion, heat transmission from the combustion gas forming the turbulent combustion to the combustion-chamber frame 11E can be small, and promotion of the turbulent combustion is not excessively disturbed.

Figure 8:
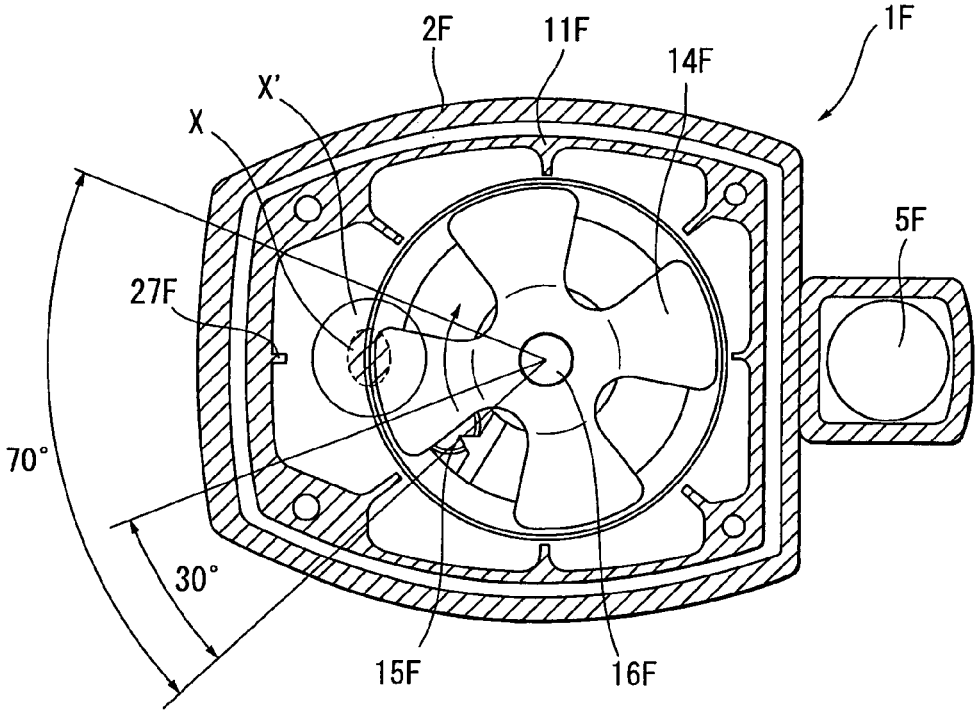
FIG. 8 is a cross-sectional view showing a combustion type nail driving tool according to a sixth embodiment and taken along a line corresponding to the line A—A of FIG. 1.

A combustion type nail driving tool 1F according to a sixth embodiment will next be described with reference to FIG. 8. The sixth embodiment is approximately the same as the first embodiment, and therefore, duplicating description will be omitted.

As described in connection with the second embodiment, the position where the combustion is most promoted is in a range of from 30 to 70 degrees about the rotation axis of the fan and from the position of the ignition plug in the rotational direction of the fan. Therefore, as shown in FIG. 8, protrusion amount of the ribs 27F protruding from the combustion-chamber frame 11F and ranging from 30 to 70 degrees about the rotation axis, i.e., motor shaft 16F and from the position of the ignition plug 15F in the rotational direction of the fan 14F is set smaller than that of the remaining ribs in order to reduce the surface area of the ribs at the specific angular range.

Thus, after the turbulent combustion occurs and when the flame propagation contour reaches the inner surface of the combustion-chamber frame 11F, heat transmission from the combustion gas to the ribs 27F can be reduced because the surface area of the ribs is small. Accordingly, after the turbulent combustion occurs and even if the flame propagation contour from the position where the turbulent combustion is most promoted reaches the inner surface of the combustion-chamber frame 11F, disturbance of promotion of the turbulent combustion can be reduced because of the reduction in heat transmission at the ribs 27F. Consequently, at an initial stage of the turbulent combustion, heat transmission from the combustion gas forming the turbulent combustion to the combustion-chamber frame 11F can be reduced, so that the excessive disturbance against the promotion of the turbulent combustion does not occur.

According to the sixth embodiment, protruding length of the specific ribs 27F from the inner surface of the combustion-chamber frame 11F is reduced at the specific area. However, surface area of the specific ribs can also be reduced by shortening the extension length of the specific ribs 27 at which the flame propagation contour of the turbulent combustion arrives.

Figure 9:
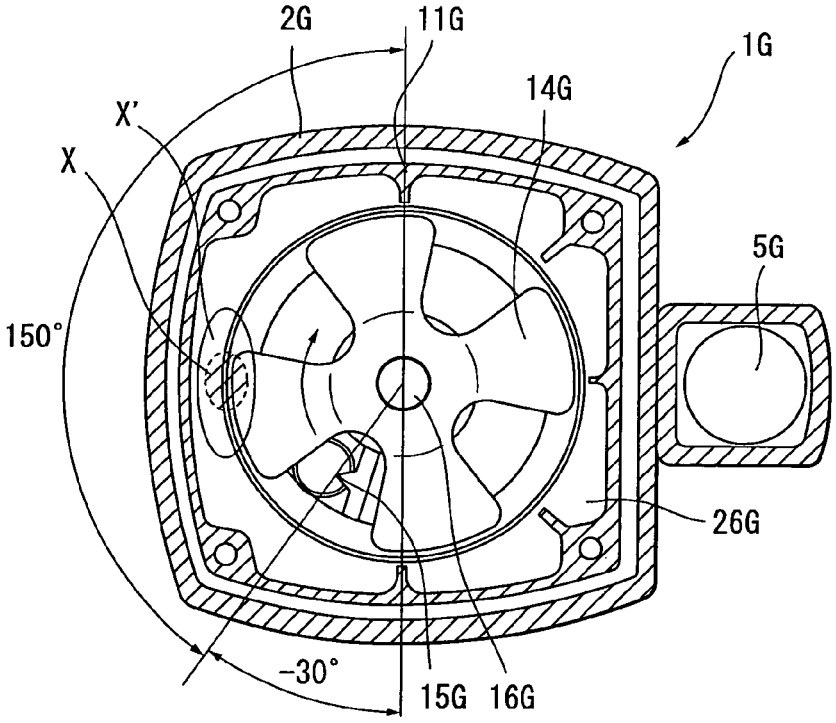
FIG. 9 is a cross-sectional view showing a combustion type nail driving tool according to a seventh embodiment and taken along a line corresponding to the line A—A of FIG. 1.

FIG. 9 shows a combustion type nail driving tool 1G according to a seventh embodiment of the present invention. The seventh embodiment is approximately the same as the first embodiment, and therefore, duplicating description will be omitted.

In the combustion type nail driving tool 1G according to the seventh embodiment, an enlargement of the outer diameter of the combustion-chamber frame 11G is prohibited because of the positional relationship to the housing 2G. Thus, a distance between the rotation axis, i.e., the axis of the motor shaft 16G and the inner surface of the combustion-chamber frame 11G is uniform over an entire circumference of the combustion-chamber frame 11G.

In the combustion type nail driving tool 1G, combustible gas is intaken into the combustion chamber 26G and the fan 14G generates an eddy current for mixing the combustible gas with air in the combustion chamber 26G. Then, the air-fuel mixture is ignited by the ignition plug 15G so as to generate combustion. In this case, similar to the combustion type nail driving tool 1A of the first embodiment, a laminar state combustion flash point with lesser heat and lesser expansion and generated at the ignition plug 15G is moved in the rotating direction of the fan 14G. After the flash point reaches an area X where high turbulence is occurring, an explosive turbulent combustion accompanying heat generation and expansion will be started from the area X. Therefore, even in the combustion type nail driving tool 1G according to the seventh embodiment, ribs 27G are locally provided at a specific inner surface of the combustion-chamber frame 11G, the specific inner surface ranging from about 150 to 330 degrees about the rotation axis of the fan 14G and from the position of the ignition plug 15G in the rotational direction of the fan 14G. In other words, ribs 27G are not provided at a region ranging from about −30 to 150 degrees about the rotation axis of the fan 14G.

With this structure, after the turbulent combustion occurs, no component is provided which robs the heat of the combustion gas until the flame propagation contour reaches the combustion-chamber frame 11G. Therefore, development of the turbulent combustion is not disturbed. Accordingly, at the initial stage of the turbulent combustion, heat transmission from the combustion gas forming the turbulent combustion to the combustion-chamber frame 11G does not occur. As a result, the development of the turbulent combustion is not disturbed. Even if the flame propagation contour of the turbulent combustion reaches the combustion-chamber frame 11G at an initial stage of the turbulent combustion, heat transmission through the ribs does not occur because no rib 27G is provided at the position near the reaching area. Accordingly, even if the flame propagation contour of the turbulent combustion reaches the combustion-chamber frame 11G at the initial stage of the turbulent combustion, amount of heat transmission of the combustion gas forming the turbulent combustion to the combustion-chamber frame 11G is small. As a result, promotion of the turbulent combustion is not excessively disturbed.

Figure 10:
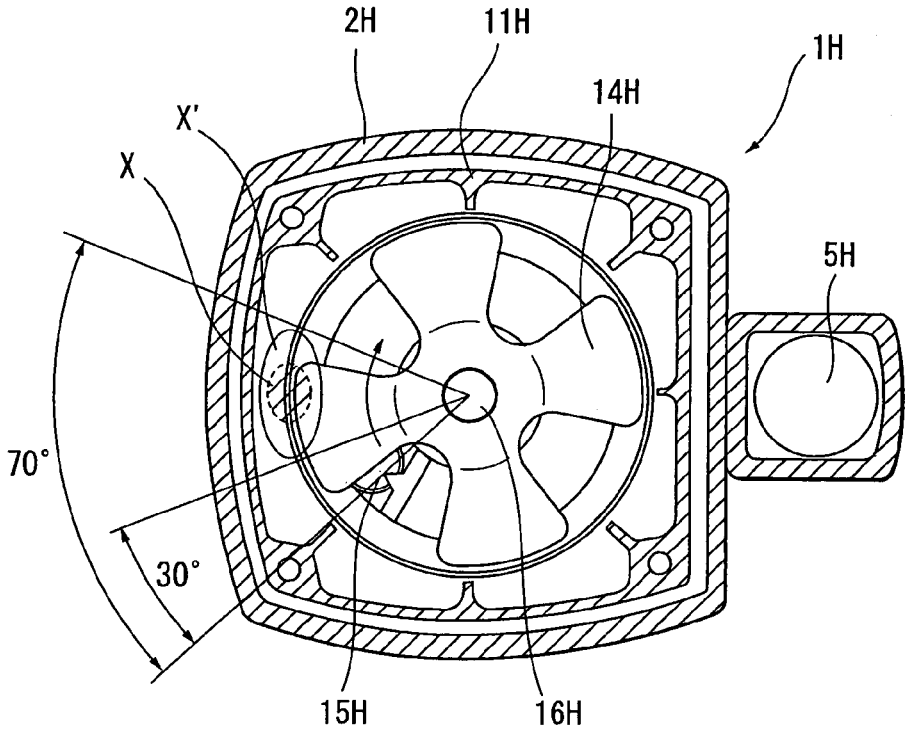
FIG. 10 is a cross-sectional view showing a combustion type nail driving tool according to an eighth embodiment and taken along a line corresponding to the line A—A of FIG. 1.

FIG. 10 shows a combustion type nail driving tool 1H according to an eighth embodiment of the present invention. In the combustion type nail driving tool 1H, an enlargement of the outer diameter of the combustion-chamber frame 11H is prohibited because of the positional relationship to the housing 2H, similar to the seventh embodiment. Thus, a distance between the rotation center of the fan 14H and the inner surface of the combustion-chamber frame 11H is uniform over an entire circumference of the combustion-chamber frame 11H. Remaining arrangement of the eighth embodiment is approximately the same as the first embodiment, and therefore, duplicating description will be omitted.

As described in connection with the second embodiment, the position where the combustion is most promoted is ranging from 30 to 70 degrees about the rotation axis from the position of the ignition plug in the rotational direction of the fan. Therefore, as shown in FIG. 10, ribs 27H are disposed at least at the area ranging from about 0 to 30 degrees and from 70 to 360 degrees about the rotation axis of the fan, i.e., the axis of the motor shaft 16H from the position of the ignition plug 15H in the rotational direction of the fan 14H. In other words, ribs 27H are not provided at an area ranging from 30 to 70 degrees.

With this arrangement, after the turbulent combustion occurs and until the flame propagation contour reaches from the position where the turbulent combustion is most promoted to the combustion-chamber frame 11H, no component exists which robs the heat of the combustion gas. Thus, promotion of the turbulent combustion is not disturbed. Accordingly, at an initial stage of turbulent combustion, heat transmission does not occur from the combustion gas forming the turbulent combustion to the combustion-chamber frame 11H. Thus, promotion of the turbulent combustion is not disturbed. Even if the flame propagation contour of the turbulent combustion reaches the combustion-chamber frame 11H from the position where the turbulent combustion is most promoted at an initial stage of the turbulent combustion, heat transmission through the ribs does not occur because no rib 27H is provided at the position near the reaching area. Accordingly, even if the flame propagation contour of the turbulent combustion reaches the combustion-chamber frame 11H at the initial stage of the turbulent combustion, amount of heat transmission of the combustion gas forming the turbulent combustion to the combustion-chamber frame 11H is small. As a result, promotion of the turbulent combustion is not excessively disturbed.

A combustion type nail driving tool 1I according to a ninth embodiment will next be described with reference to FIG. 11. In the combustion type nail driving tool 1I, an enlargement of the outer diameter of the combustion-chamber frame 11I is prohibited because of the positional relationship to the housing 2I, similar to the seventh embodiment. Thus, a distance between the rotation center of the fan 16*i* i.e. the rotation axis of the motor shaft 16I and the inner surface of the combustion-chamber frame 11I is uniform over an entire circumference of the combustion-chamber frame 11I. Remaining arrangement of the ninth embodiment is approximately the same as the first embodiment, and therefore, duplicating description will be omitted.

Figure 11:
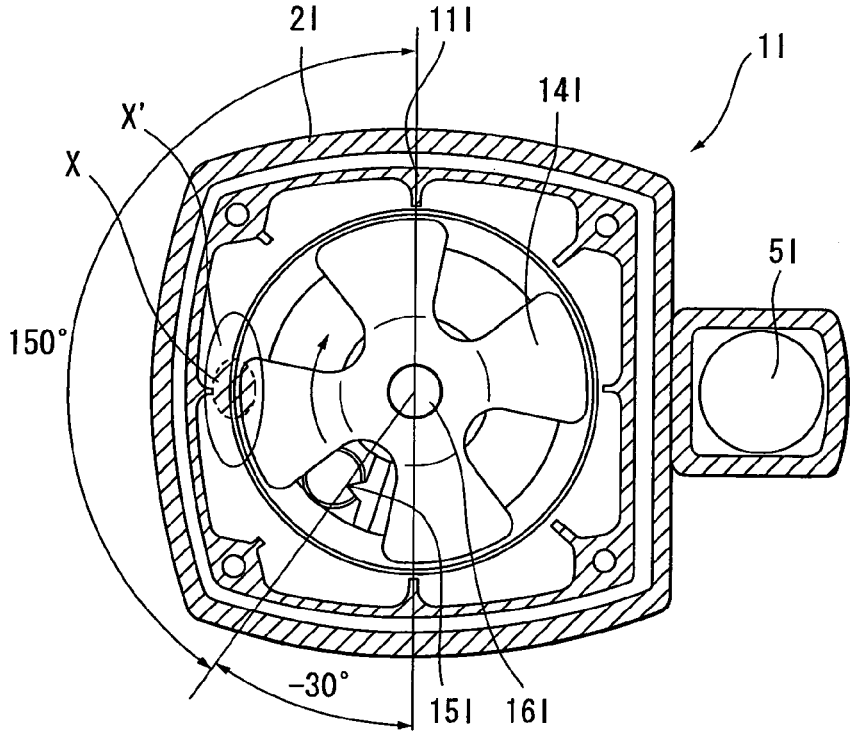
FIG. 11 is a cross-sectional view showing a combustion type nail driving tool according to a ninth embodiment and taken along a line corresponding to the line A—A of FIG. 1.

In case where ribs 27I cannot be dispensed with in view of the various parameters such as a strength of the combustion-chamber frame, as shown in FIG. 11, protrusion amount of the ribs 27I protruding from the combustion-chamber frame 11I and ranging from about −30 to 150 degrees about the rotation axis of the fan 14I and from the position of the ignition plug 15I in the rotational direction of the fan 14I is set smaller than that of the remaining ribs in order to reduce the surface area of the ribs at the specific angular range.

Accordingly, after the turbulent combustion occurs and when the flame propagation contour reaches the inner surface of the combustion-chamber frame 11I, heat transmission amount transmitted from the combustion gas to the ribs 27I can be reduced because of the small surface area of the ribs 27I. Thus, after the turbulent combustion occurs and even if the flame propagation contour reaches the inner surface of the combustion-chamber frame 11I, disturbance of promotion of the turbulent combustion can be reduced because of the reduction in heat transmission at the ribs 27I. Consequently, at an initial stage of the turbulent combustion, heat transmission from the combustion gas forming the turbulent combustion to the combustion-chamber frame 11I can be reduced, so that the excessive disturbance against the promotion of the turbulent combustion does not occur.

Figure 12:
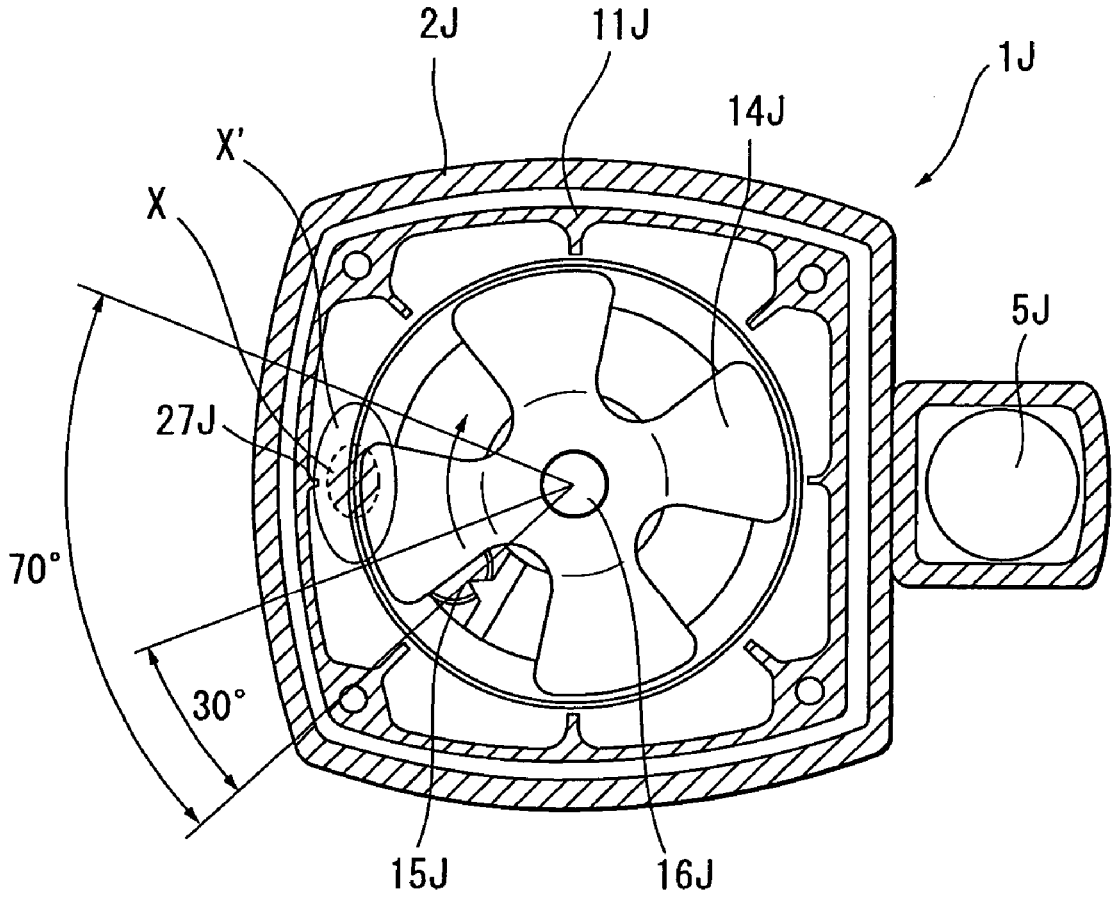
FIG. 12 is a cross-sectional view showing a combustion type nail driving tool according to a tenth embodiment and taken along a line corresponding to the line A—A of FIG. 1.

A combustion type nail driving tool 1J according to a tenth embodiment will next be described with reference to FIG. 12. In the combustion type nail driving tool 1J, an enlargement of the outer diameter of the combustion-chamber frame 11J is prohibited because of the positional relationship to the housing 2J, similar to the seventh embodiment. Thus, a distance between the rotation center of the fan 14*j*, i.e., the rotation axis of the motor shaft 16J and the inner surface of the combustion-chamber frame 11J is uniform over an entire circumference of the combustion-chamber frame 11J. Remaining arrangement of the tenth embodiment is approximately the same as the first embodiment, and therefore, duplicating description will be omitted.

As described in connection with the second embodiment, the position where the combustion is most promoted is ranging from 30 to 70 degrees about the rotation axis from the position of the ignition plug in the rotational direction of the fan. In case where ribs 27J cannot be dispensed with in view of the various parameters such as a strength of the combustion-chamber frame, protrusion amount of the ribs 27J protruding from the combustion-chamber frame 11J and ranging from about 30 to 70 degrees about the rotation axis 16J and from the position of the ignition plug 15J in the rotational direction of the fan 14J is set smaller than that of the remaining ribs in order to reduce the surface area of the ribs at the specific angular range.

Accordingly, after the turbulent combustion occurs and when the flame propagation contour reaches the inner surface of the combustion-chamber frame 11J, heat transmission amount transmitted from the combustion gas to the ribs 27J can be reduced because of the small surface area of the ribs 27J. Thus, after the turbulent combustion occurs and even if the flame propagation contour from the position where the turbulent combustion is most promoted reaches the inner surface of the combustion-chamber frame 11J, disturbance of promotion of the turbulent combustion can be reduced because of the reduction in heat transmission at the ribs 27J. Consequently, at an initial stage of the turbulent combustion, heat transmission from the combustion gas forming the turbulent combustion to the combustion-chamber frame 11J at the position where the turbulent combustion is most promoted can be reduced, so that the excessive disturbance against the promotion of the turbulent combustion does not occur.

According to the ninth and tenth embodiments, the surface area of the ribs are reduced by reducing protruding length of the ribs from the inner surface of the combustion-chamber frame in order to reduce heat absorbing amount at the surface of the ribs. However, various modifications are available in these embodiments, such that an interval between neighboring ribs at the specific area is set greater than that at the other area. Alternatively, extension length of the specific ribs can be set smaller than that of the remaining ribs. Thus, surface area of the specific ribs can be reduced to lower the heat absorption amount at the surface of the specific ribs.

While the invention has been described in detail and with reference to specific embodiments thereof, it would be apparent to those skilled in the art that various changes and modification may be made in any kind of power tools in which a combustion chamber and a piston are provided, and as long as expansion of gas as a result of combustion of air-fuel mixture in the combustion chamber causes reciprocal motion of the piston.

What is claimed is:

1. A combustion chamber arrangement in a combustion-type power tool comprising:

a combustion-chamber frame having an inner wall defining a combustion chamber;

a fan disposed in the combustion chamber and rotatable about an axis in a rotational direction; and an ignition plug exposed to the combustion chamber, and wherein the combustion-chamber frame has a specific section and a remaining section other than the specific section, and a distance between the axis and the inner wall of the specific section in a plane perpendicular to the axis is greater than a distance between the axis and the inner wall of the remaining section in the plane, the specific section ranging from −30 to 150 degrees about the axis relative to a connection line connecting between the axis and the ignition plug in the rotational direction.

2. The combustion chamber arrangement as claimed in claim 1, wherein the specific section is ranging from 30 to 70 degrees about the axis relative to the connection line in the rotational direction.

3. The combustion chamber arrangement as claimed in claim 2, further comprising a plurality of ribs extending in the axial direction and protruding from the inner wall toward the axis of the fan and spaced away from each other, the plurality of ribs being only located at an area ranging from 150 to 330 degrees about the axis relative to the connection line in the rotational direction.

4. The combustion chamber arrangement as claimed in claim 2, further comprising a plurality of ribs extending in the axial direction and protruding from the inner wall of the combustion-chamber frame toward the axis of the fan and spaced away from each other, the plurality of ribs being only located at an area ranging from 0 to 30 degrees and from 70 to 360 degrees about the axis relative to the connection line in the rotational direction.

5. The combustion chamber arrangement as claimed in claim 2, further comprising a first plurality of ribs and a second plurality of ribs each extending in the axial direction of the fan and protruding from the inner wall toward the axis of the fan and spaced away from each other, a surface area of the rib per a unit angle about the axis in the first plurality of ribs being smaller than that in the second plurality of ribs, the first plurality of ribs ranging from −30 to 150 degrees about the axis of the fan relative to the connection line in the rotational direction.

6. The combustion chamber arrangement as claimed in claim 5, wherein first plurality of ribs ranges from 30 to 70 degrees about the axis of the fan relative to the connection line in the rotational direction.

7. The combustion chamber arrangement as claimed in claim 1, further comprising a plurality of ribs extending in the axial direction and protruding from the inner wall toward the axis of the fan and spaced away from each other, the plurality of ribs being only located at an area ranging from 150 to 330 degrees about the axis relative to the connection line in the rotational direction.

8. The combustion chamber arrangement as claimed in claim 1, further comprising a plurality of ribs extending in the axial direction and protruding from the inner wall of the combustion-chamber frame toward the axis of the fan and spaced away from each other, the plurality of ribs being only located at an area ranging from 0 to 30 degrees and from 70 to 360 degrees about the axis relative to the connection line in the rotational direction.

9. The combustion chamber arrangement as claimed in claim 1, further comprising a first plurality of ribs and a second plurality of ribs each extending in the axial direction of the fan and protruding from the inner wall toward the axis of the fan and spaced away from each other, a surface area of the rib per a unit angle about the axis in the first plurality of ribs being smaller than that in the second plurality of ribs, the first plurality of ribs ranging from −30 to 150 degrees about the axis of the fan relative to the connection line in the rotational direction.

10. The combustion chamber arrangement as claimed in claim 9, wherein first plurality of ribs ranges from 30 to 70 degrees about the axis of the fan relative to the connection line in the rotational direction.

11. A combustion-type power tool comprising:

a housing having one end and a lower side;

a head section closing the one end of the housing and formed with a combustible gas passage;

a push lever provided to the lower side of the housing and movable upon pushing onto a workpiece;

a cylinder secured to an inside of the housing;

a piston slidably disposed in the cylinder and reciprocally movable in an axial direction of the cylinder, the piston dividing the cylinder into an upper cylinder space above the piston and a lower cylinder space below the piston;

a combustion-chamber frame provided in the housing and guidedly movable along the cylinder, the combustion-chamber frame having one end abuttable on and separable from the head section in interlocking relation to the movement of the push lever, a combination of the combustion-chamber frame, the head section and the cylinder space above the piston defining a combustion chamber;

a motor disposed at the head section;

a fan rotatably positioned in the combustion chamber and driven by the motor; and an ignition plug provided at the head section and exposed to the combustion chamber;

wherein the combustion-chamber frame has a specific section and a remaining section other than the specific section, and a distance between an axis of the fan and an inner wall of the specific section in a plane perpendicular to the axis being greater than a distance between the axis of the fan and an inner wall of the remaining section in the plane, the specific section ranging from −30 to 150 degrees about the axis of the fan relative to a connection line connecting between the axis of the fan and the ignition plug in a rotational direction of the fan.

* * * * *